United States Patent [19]

Taniuchi

[11] 3,993,010

[45] Nov. 23, 1976

[54] PROCESS AND APPARATUS FOR FORMING REARABLY DETACHABLE PORTION ON SHEET

[76] Inventor: Keiji Taniuchi, No. 6-7,2-chome, Nishi-Koujiya, Ohta, Tokyo, Japan

[22] Filed: Feb. 21, 1975

[21] Appl. No.: 551,591

[30] Foreign Application Priority Data

July 4, 1974 Japan ..... 49-75868
Aug. 14, 1974 Japan ..... 49-92297

[52] U.S. Cl. ..... 113/121 C; 72/326; 113/15 R; 113/15 A

[51] Int. Cl.[2] ..... B21D 51/38

[58] Field of Search..... 113/1 F, 116 R, 116 QA, 113/116 V, 120 Q, 121 R, 121 A, 121 C, 15 R, 15 A; 72/324, 326, 332; 83/1, 5, 6, 7, 51

[56] References Cited

UNITED STATES PATENTS

| | | | |
|---|---|---|---|
| 1,272,890 | 7/1918 | Bates | 113/15 R |
| 3,705,563 | 12/1972 | Elser | 113/121 C |
| 3,741,142 | 6/1973 | Stuard | 113/121 C |
| 3,765,352 | 10/1973 | Schubert et al. | 113/121 C |
| 3,768,295 | 10/1975 | Cudzik | 113/1 F X |
| 3,848,557 | 11/1974 | Holk | 113/15 A |
| 3,868,919 | 3/1975 | Schrecker et al. | 113/121 C |
| 3,871,314 | 3/1975 | Stargell | 113/121 C |
| 3,878,704 | 4/1975 | Shea | 72/326 |

*Primary Examiner*—Victor A. DiPalma
*Attorney, Agent, or Firm*—Zarley, McKee, Thomte & Voorhees

[57] ABSTRACT

The periphery of a tearably detachable portion of a sheet such as the lid of a pop-top can is weakened by forming a continuous thin wall at the periphery of the detachable portion. The thin wall is then folded to further weaken the periphery of the detachable portion.

11 Claims, 7 Drawing Figures

PROCESS AND APPARATUS FOR FORMING REARABLY DETACHABLE PORTION ON SHEET

The present invention relates to a process and apparatus for forming a tearably detachable portion on a sheet such as the lid of a pop-top can.

It is well known and popular to provide beverage and other cans with pop-top lids. A continuous groove of suitable shape is cut in the surface of the lid to define a tearably detachable portion, and a handle or tab is riveted to the portion near the periphery. The portion or pop-top is torn from the can by pulling the tab back across the surface of the portion.

A problem is encountered in the manufacture of pop-top cans in that a tremendous force is required to cut a continuous groove in the top of a steel can lid deep enough that the portion can be easily and cleanly torn from the lid, since the groove is cut in one operation by a die. Apparatus with sufficient power to perform such a grooving operation on a steel can lid must necessarily be massive in size and expensive to manufacture and operate. The problem is generally overcome in practice by making the can body out of steel and the can lid out of aluminum, which is much easier to form than steel. However, aluminum is more expensive than steel, adding to the cost of the can. Aluminum cans and lids for this reason are sometimes recycled. However, due to the high cost of recycling involving separation of the lid and the can body from each other, it is highly desirable in the art of making cans to make the cans entirely out of steel so that the cans can be easily recycled without separating the can lid from the can body.

It is therefore an object of the present invention to provide a process for forming a tearably detachable portion or pop-top on a can which can be applied to steel can lids.

It is another object of the present invention to provide a process for forming a tearably detachable portion or pop-top on a can by which used cans can be easily recycled in an economical manner.

It is another object of the present invention to provide an apparatus for performing the above process.

It is another object of the present invention to provide an apparatus to form a tearably detachable portion on a sheet of metal, which may be a can lid, utilizing less power than prior art apparatus.

It is another object of the present invention to provide an apparatus to form a tearably detachable portion on a can lid, the apparatus being smaller in size and less expensive to manufacture and operate than prior art apparatus.

The above and other objects, features and advantages of the present invention will become more apparent from the following description when taken in conjunction with the accompanying drawings, in which.

Figure 1:
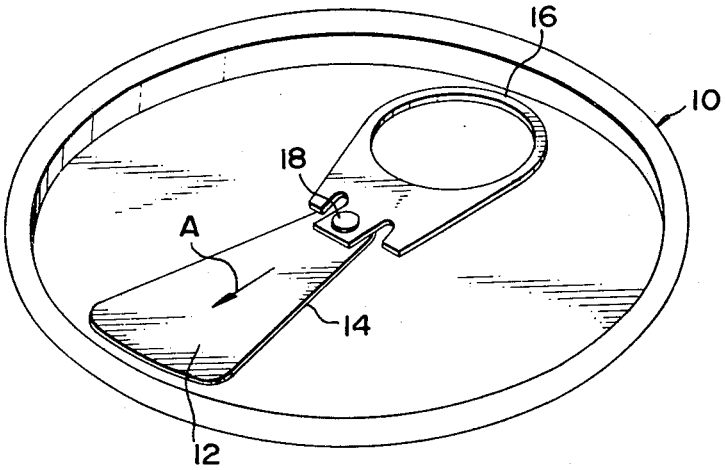
FIG. 1 is a perspective view of a pop-top can lid formed in accordance with the present invention.

Referring now to FIG. 1, a pop-top can lid 10 (the can is not shown) is formed with a tearably detachable portion 12. The portion 12 is recessed from the remainder of the can lid 10 and is defined by a continuous folded wall 14. The portion 12 may be of any desired shape, but is preferably of the shape shown which is known in the art. A handle or tab 16 formed with a hole (no numeral) is fastened to the portion 12 near the wall 14 by a rivet 18. A person desiring to open the can inserts a finger through the hole in the tab 16 and pulls the tab 16 in the direction of an arrow A. This operation causes the attached portion 12 to be cleanly and easily torn from the remainder of the can lid 10.

Figure 2:
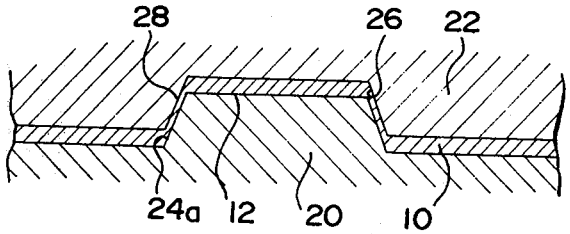
FIG. 2 is a fragmentary sectional view of dies adapted to perform the first step of a two step forming process on a can lid.

The present invention contemplates to provide a two step process for forming the tearably detachable portion 12. The pop-top can lid 10 is firstly recessed as shown in FIG. 2. Lower and upper dies 20 and 22 are provided. The lower die 20 is formed with a protrusion 24 having the tapered periphery 24*a* and the upper die 22 is formed with a continuous recess 26 conjugate to the tapered periphery 24*a* of the protrusion 24. As shown, the recess 26 has a tapered periphery 26*a* adapted to face the periphery 24*a* of the protrusion 24. The shapes of the protrusion 24 and the recess 26 are essentially the same as the periphery of the tearably detachable portion 12.

In operation, dies 20 and 22 are brought together with sufficient force to recess the tearably detachable portion 12 so that a continuous thin wall or inclined wall 28 is formed between the tapered walls 24*a* and 26*a* of the protrusion 24 and the recess 26 by elastic and/or plastic deformation of the material of the can lid 10, which is preferably steel, in a manner well known in the art of metal working. The wall 28 represents the weakest part of the can lid 10 and will yield when the tab 16 is pulled so that the portion 12 is cleanly torn from the lid 10. In accordance with the present invention, the metal defining the inclined wall 28 is plastically elongated by performing the first step of the process as shown in FIG. 2 to form the weakest part of the lid 10. The weakening of the periphery of the portion 12 is further performed in the second step of the process in accordance with the present invention so that the force applied to the lid 10 to form the portion 12 may be much lower than if the process is performed in only one operation as in prior art.

Figure 3:
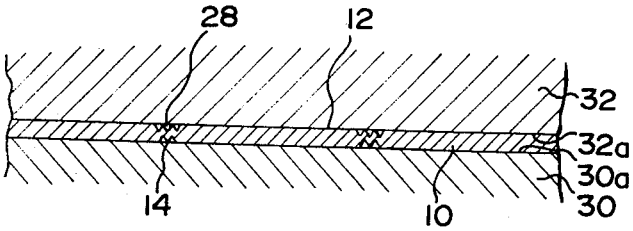
FIG. 3 is similar to FIG. 2, but shows other dies performing the second step of the process.

The second step of the process is performed as shown in FIG. 3. Another lower die 30 and upper die 32 are provided. The lower and upper dies 30 and 32 respectively have flat surfaces 30*a* and 32*a*. The dies 30 and 32 are brought together with sufficient force so that the tapered wall 28 of the can lid 10 is formed into a folded wall 14. The metal in the area of the folded wall 14 is considerably weaker than the remainder of the can lid 10. It will thus be noted that in accordance with an important feature of the present invention the weakened thin wall 28 becomes even further weakened by the folding step as shown in FIG. 3 to the extent that the portion 12 may be easily torn from the can lid 10.

Figure 4:
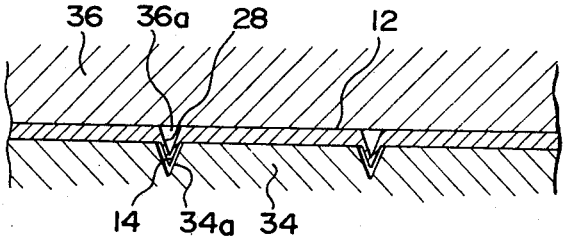
FIG. 4 is a fragmentary sectional view of a modification of the dies adapted to perform the second step of the process.

The folding step of the process may be performed in a manner as shown in FIG. 4, in which like component parts are designated by the same reference numerals as those used in FIG. 3. A lower die 34 is formed with a V-shaped continuous groove 34*a* having the shape of the periphery of the detachable portion 12 and an upper die 36 is formed with a sharp continuous ridge 36*a* conjugate to the shape of the groove 34*a*. After the can lid 10 is recessed as shown in FIG. 2, the can lid 10 is placed between the upper and lower dies 36 and 34. The upper and lower dies are then brought together with sufficient force so that the sharp ridge 36*a* forces the wall 28 of the lid 10 into the V-shaped recess 34*a* to form the folded wall 14. The metal in the area of the folded wall is weaker than the remaining part of the lid 10 so that the portion 12 is easily torn from the remainder of the can lid 10.

Figure 5:
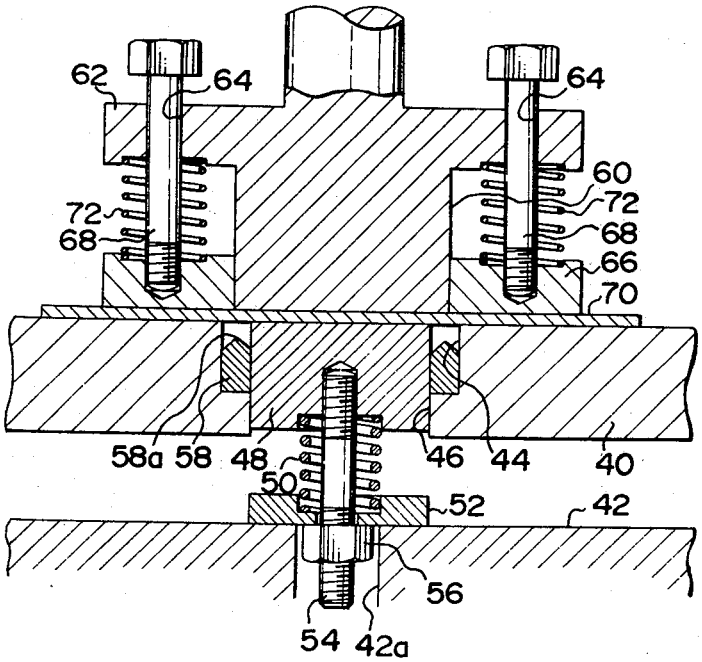
FIG. 5 is a fragmentary sectional view of an apparatus embodying the present invention performing the process of the present invention.

FIG. 5 shows a preferred embodiment of an apparatus embodying the present invention adapted to perform a two step forming process on the can lid. The apparatus is shown to comprise a lower die 40 spaced from a base 42 with a certain distance. The lower die 40 is formed with first and second axially extending bores 44 and 46, which are similar in cross section to the shape of a tearably detachable portion of a can lid. A loader block 48 is slidably received in the second bore 46 of the lower die 40 and is urged upward by a suitable biasing means such as a compression spring 50. The compression spring 50 is disposed between the loader block 48 and a fixed plate 52 on the base 42. The loader block 48 is shaped to be conjugate to the periphery of the detachable portion of the can lid. A ring-like member 58 having a continuous angle ridge 58*a* is disposed in the first bore 44 of the lower die 40. The shape of the continuous ridge 58*a* is formed to be conjugate to the periphery of the tearably detachable portion of the can lid. The height of the ring-like member 58 must be less than the depth of the first bore 44 of the lower die 40. An upper die 60 having the periphery conjugate to the first bore 44 of the lower die 40 is arranged to be movable concentrically with the loader block 48 slidably disposed in the second bore 46 of the lower die 40. The upper die 60 is formed with an annular flange 62, in which a plurality of bores 64 are formed. An annular pressure plate 66 is slidably disposed on the upper die 60 and is movably supported by a plurality of bolts 68 which are slidable within the plurality of bores 64 of the flange 62, respectively. In order to urge the pressure plate 66 against the can lid 70 on the lower die 40, a plurality of biasing means such as compression springs 72 are disposed between the flange 62 and the pressure plate 66.

Figure 6:
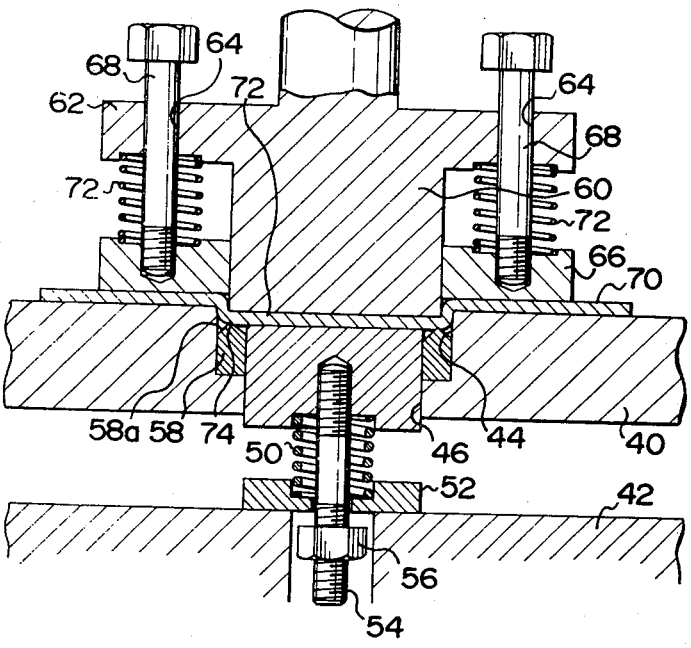
FIG. 6 is similar to FIG. 5, but shows the dies performing the first step of the process.
Figure 7:
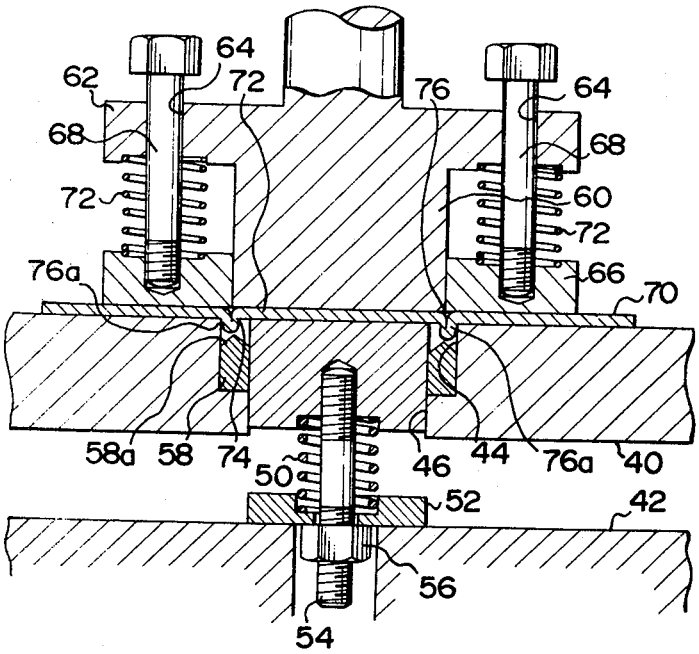
FIG. 7 is similar to FIG. 5, but shows the dies performing the second step of the process.

In operation, the can lid 70 is disposed between the upper and lower dies 60 and 40 and is held stationary by the pressure plate 66 by the actions of the compression springs 72 as shown in FIG. 5. Thereafter, the upper die 60 is pressed downward as shown in FIG. 6 against the force of the compression spring 50 acting on the loader block 48. In this instance, the can lid 70 is recessed by a lower end of the upper die and the adjacent inner wall of the first bore 44 of the lower die 40 so that a detachable portion 72 is formed in the can lid 70. At the same time, the continuous ridge 58*a* of the ring-like member 58 cuts a continuous groove 74 in the can lid 70. The continuous groove 74 represents the weakest part of the can lid 70. Next, as the upper die 60 is moved upward to its original position, the loader block 48 is moved upward to its original position by the action of the compression spring 50 while pressing the detachable portion 72 against the bottom wall of the upper die 60. In this case, the detachable portion 72 is raised to a position in which the upper surface of the portion 72 is on the same plane with the remainder of the can lid 70 and a continuous folded wall 76 is formed at the continuous groove 74 on the can lid 70 so that the metal at the folded wall becomes even further weakened to the extent that the portion 72 may be easily torn from the can lid 70. It will be understood that, while a difficulty is encountered in the prior art pop-top can in pulling the tab to open the lid since the force applied to the tab is dissipated through the entire part of the can lid and a deformation of the lid is caused, the can lid formed in accordance with the present invention is easily opened since a rigid portion 76*a* is formed at the continuous side wall of the folded wall 76 and prevents the deformation of the lid. It will further be noted that since the side wall of the folded wall 76 extends inward, a person will be unharmed even when he puts lips to the opening portion of the can lid 70.

It will now be understood from the foregoing description that in accordance with the present invention the can lid is formed with a continuous weakened wall portion at the periphery of the tearably detachable portion of a can lid and the weakened wall portion is further weakened by folding operation so that the detachable portion may be easily torn from the remainder of the can lid and, hence, the can lid can be made of a relatively hard material such as steel.

I claim:

1. Apparatus for forming a tearably detachable portion on a sheet comprising:

first die means having the shape of the periphery of the tearably detachable portion;

second die means formed with first and second axially extending bores, said first axially extending bore being conjugate to the shape of said first die means;

a ring-like member disposed in said first axially extending bore of said second die means and having a continuous ridge having the shape of the tearably detachable portion; and loader means slidably received in said second axially extending bore of said second die means and having a shape conforming to and being slightly smaller than said shape of said continuous ridge;

said first die means being movable from a first position spaced axially above said first bore to a second position within said first bore for deforming said detachable portion of said sheet member and pressing said detachable portion against said continuous ridge of said ring like member;

said loader means being movable axially towards said first die means from a first position spaced axially below said deformed sheet member to a second position wherein said sheet member is further deformed upwardly to create a folded wall around the periphery of said detachable portion.

2. Apparatus according to claim 1, further comprising biasing means for biasing said loader means toward said first die means.

3. Apparatus according to claim 1, in which the height of said ring-like member is selected to be less than the depth of said first axially extending bore of said second die means.

4. Apparatus according to claim 1, further comprising pressure plate means urged toward said second die means to press the sheet on said second die means.

5. Apparatus according to claim 2, further comprising a base formed with an axially extending bore and a fixed plate on said base, and in which said biasing means is disposed between said loader means and said fixed plate.

6. Apparatus according to claim 4, further comprising means to limit the travel path of said loader means.

7. A process for forming a tearably detachable portion on a sheet, comprising the steps of:

a. recessing the tearably detachable portion to form a continuous thin wall at the periphery of the detachable portion; and b. folding the thin wall to form a folded portion therein to weaken the periphery of the detachable portion, said folding step comprising pressing the sheet so that the detachable portion is aligned to be on the same plane with a remaining part of the sheet.

8. A process according to claim 7, in which step (a) comprises plastically elongating the sheet at the periphery of the detachable portion.

9. A process according to claim 7, in which step (b) is performed by first and second dies having flat surfaces respectively.

10. A process according to claim 7, in which step (b) is performed by a first die having a continuous ridge and a second die having a continuous groove conjugate to the shape of the ridge.

11. A process according to claim 7 wherein said thin wall is formed by creating a continuous groove in said sheet.

* * * * *